US007975502B2

(12) United States Patent
Tamura et al.

(10) Patent No.: US 7,975,502 B2
(45) Date of Patent: Jul. 12, 2011

(54) HEAT PUMP APPARATUS AND OPERATING METHOD THEREOF

(75) Inventors: Tomoichiro Tamura, Kyoto (JP); Yuuichi Yakumaru, Osaka (JP); Masaya Honma, Osaka (JP); Fumitoshi Nishiwaki, Hyougo (JP)

(73) Assignee: Panasonic Corporation, Kadoma-shi (JP)

( * ) Notice: Subject to any disclaimer, the term of this patent is extended or adjusted under 35 U.S.C. 154(b) by 584 days.

(21) Appl. No.: 10/589,129

(22) PCT Filed: Feb. 17, 2005

(86) PCT No.: PCT/JP2005/002944

§ 371 (c)(1),
(2), (4) Date: Aug. 11, 2006

(87) PCT Pub. No.: WO2005/080896

PCT Pub. Date: Sep. 1, 2005

(65) Prior Publication Data

US 2007/0163277 A1 Jul. 19, 2007

(30) Foreign Application Priority Data

Feb. 19, 2004 (JP) ..... 2004-043543

(51) Int. Cl.

| | |
|---|---|
| ***F25B 13/00*** | (2006.01) |
| ***F25B 27/00*** | (2006.01) |
| ***F25B 1/00*** | (2006.01) |
| ***F26B 19/00*** | (2006.01) |
| ***F26B 25/06*** | (2006.01) |
| ***F26B 3/00*** | (2006.01) |

(52) U.S. Cl. ..... 62/324.1; 62/324.3; 62/498; 34/477; 34/476; 34/210; 34/212; 34/219

(58) Field of Classification Search ..... 62/324.1, 62/324.3, 498; 34/477, 476, 210, 212, 218, 34/219

See application file for complete search history.

(56) References Cited

U.S. PATENT DOCUMENTS 4,621,438 A * 11/1986 Lanciaux ..... 34/77

(Continued)

FOREIGN PATENT DOCUMENTS

JP 61-93332 5/1986

(Continued)

OTHER PUBLICATIONS

Office Action dated Jan. 19, 2010 issued in corresponding Japanese Patent Application No. 2005-006315 with English translation.

*Primary Examiner* — Thomas E Denion
*Assistant Examiner* — Michael Carton
(74) *Attorney, Agent, or Firm* — Kratz, Quintos & Hanson, LLP

(57) ABSTRACT

In a heat pump apparatus of the invention, a refrigerant is circulated through a compressor 31, a radiator 32, a first throttle apparatus 33, a heat exchanger 34, a second throttle apparatus 35 and an evaporator 36 in this order. The heat exchanger 34 can be utilized as both a radiator and an evaporator by operating the first throttle apparatus 33 and the second throttle apparatus 35. Therefore, even if the outside air temperature is high, discharge pressure and suction pressure of the compressor do not rise, the heat pump apparatus can be operated in a stable refrigeration cycle, and energy can be saved.

6 Claims, 10 Drawing Sheets

U.S. PATENT DOCUMENTS

| | | | | |
|---|---|---|---|---|
| 6,494,051 | B2 * | 12/2002 | Sakakibara et al. | 62/225 |
| 2001/0018831 | A1 * | 9/2001 | Honda | 62/228.1 |
| 2002/0046570 | A1 * | 4/2002 | Itoh et al. | 62/324.1 |
| 2004/0079096 | A1 | 4/2004 | Itoh et al. | |

FOREIGN PATENT DOCUMENTS

| | | | |
|---|---|---|---|
| JP | 2002-19443 | | 1/2002 |
| JP | 2002-61991 | | 2/2002 |
| JP | 2002-364939 | | 12/2002 |
| JP | 2003-148830 | | 5/2003 |
| JP | 2003-265880 | | 9/2003 |
| JP | 2004-3745 | | 1/2004 |
| JP | 2004-3801 | | 1/2004 |
| JP | WO 2004/051157 | A1 | 6/2004 |
| WO | WO 03/083381 | A1 | 10/2003 |

* cited by examiner

HEAT PUMP APPARATUS AND OPERATING METHOD THEREOF

TECHNICAL FIELD

The present invention relates to a drying apparatus used for drying clothing or bathroom, or for a vending machine, and to an operating method of the drying apparatus.

BACKGROUND TECHNIQUE

As a conventional heat pump apparatus, there is a heat pump type drying apparatus in which a heat pump is used as a heat source and drying air is circulated (see patent document 1 for example). FIG. 10 shows a structure of the conventional heat pump type drying apparatus described in the patent document 1.

In the clothing dryer shown in FIG. 10, a rotation drum 2 is used as a drying room which is provided in a body 1 of the clothing dryer so as to rotate freely. The rotation drum 2 is driven by a motor 3 through a drum belt 4. A blower 22 is driven by the motor 3 through a fan belt 8. The blower 22 sends drying air from the rotation drum 2 to a circulation duct 18 through a filter 11 and a rotation drum-side air intake 10.

The heat pump apparatus comprises an evaporator 23 which evaporates a refrigerant to dehumidify drying air, a condenser 24 for condensing the refrigerant to heat the drying air, a compressor 25 for generating a pressure difference in the refrigerant, an expansion mechanism 26 such as a capillary tube for maintaining the pressure difference of the refrigerant, and a pipe 27 through which the refrigerant passes. A portion of the drying air heated by the condenser 24 is discharged outside from the body 1 through an exhaust port 28.

Next, the operation of the drying apparatus will be explained. First, clothing 21 to be dried is placed in the rotation drum 2. Then, if the motor 3 is rotated, the rotation drum 2 and the blower 22 rotate and drying air flow B is generated. The drying air absorbs water from the clothing 21 in the rotation drum 2 and takes up much moisture and then, the air is sent to the evaporator 23 of the heat pump apparatus through the circulation duct 18 by the blower 22. The drying air from which heat is absorbed by the evaporator 23 is dehumidified and sent to the condenser 24 and heated therein, and the air is again circulated into the rotation drum 2. A drain outlet 19 is provide in a middle portion of the circulation duct 18, and a drain dehumidified and generated by the evaporator 23 is discharged out through the drain outlet 19. As a result, the clothing 21 is dried.

(Patent Document 1)

Japanese Patent Application Laid-open No. H7-178289

However, the structure of the conventional heat pump type drying apparatus has a problem that when the heat pump is operated under high temperature atmosphere, the discharge pressure of the compressor rises.

A principle of the discharge pressure rise of the compressor when the heat pump is operated under high temperature atmosphere will be explained. In a heat pump type drying apparatus having a circulation duct, input from an outside power source into the compressor and heat release from air circulating in the duct into outside become equal to each other in a steady state. That is, if the input into the compressor is constant, a difference between the atmosphere temperature and the average temperature of air in the circulation duct is always constant. Thus, if the atmosphere temperature rises, the average temperature of air in the circulation duct rises. For this reason, refrigerant pressure sucked into and discharged out from the circulation duct rises, and there is a danger that this pressure exceeds permissive pressure of the compressor.

The conventional structure has a problem that when the heat pump is operated under high temperature atmosphere, COP (coefficient of performance) of the heat pump is deteriorated, and electricity required for drying operation is increased.

A principle that the COP (coefficient of performance) of the heat pump when the heat pump is operated under the high temperature atmosphere is deteriorated will be explained. As described above, if the atmosphere temperature rises, the average temperature of air in the circulation duct rises, and a pressure of refrigerant sucked by the compressor rises. With this, the density of refrigerant sucked by the compressor is increased, and a circulation amount of the refrigerant in the heat pump cycle is increased. Thus, the heat pump cycle is shifted as shown in FIG. 11, an enthalpy difference of the refrigerant in the radiator is reduced, and the COP of the heat pump cycle is deteriorated.

The conventional structure has a problem that in the drying process, as the drying operation is proceeded, the drying speed is largely reduced, and the drying time is increased.

A reason why the drying speed is largely reduced as the drying operation is proceeded will be explained. Generally, when a solid body is to be dried using warm air, it is known that as the drying operation is proceeded, contend of water on a surface of the solid body to be dried is reduced, and the drying speed is reduced. In addition, when clothing is to be dried by using a rotation drum or the like, as the drying operation is proceeded, clothing is largely deviated in the rotation drum, and a transfer resistance of heat from the clothing surface to water remaining in the clothing is increased. Thus, according to the conventional structure, the transfer amount of heat into the clothing is reduced, the drying speed is further reduced as compared with general drying characteristics, and electric power consumption required for the drying operation is increased.

Further, an HFC refrigerant (a refrigerant including hydrogen atom, fluorine atom, and carbon atom in a molecule) which is currently used as a refrigerant of the heat pump apparatus directly affects the global warming and thus, it is proposed to convert such a refrigerant into a natural refrigerant such as carbon dioxide ($CO_2$, hereinafter) existing in the natural environment as an alternative refrigerant. However, if the $CO_2$ refrigerant is used, theoretic efficient of the heat pump system is low as compared with the HFC refrigerant, and the operating efficiency of the heat pump type drying apparatus is deteriorated. Thus, there is a problem that energy must be saved and the efficiency must be enhanced to reduce the indirect affect on the global warming by using a natural refrigerant such as $CO_2$ which does not directly affect the global warming.

The present invention has been accomplished in view of the conventional problems, and it is an object of the invention to provide a drying apparatus which enhances its efficiency while avoiding the excessive rise of the discharge pressure of the compressor also under a high outside temperature condition when a refrigerant that is brought into a supercritical state on the radiation side of a heat pump cycle such as $CO_2$ is used as a refrigerant.

DISCLOSURE OF THE INVENTION

A first aspect of the present invention provides a drying apparatus comprising a heat pump apparatus in which a refrigerant is circulated through a compressor, a radiator, a first throttle apparatus, a heat exchanger, a second throttle apparatus and an evaporator in this order, a circulation duct through which drying air is circulated and in which the radiator, the heat exchanger and the evaporator are disposed in this order from upstream side of flow of the drying air, and a drying room connected to the circulation duct.

With this aspect, switching operation between the first throttle apparatus and the second throttle apparatus is carried out and thus, the heat exchanger can be utilized as the second radiator or the second evaporator. Therefore, this aspect provides the operating method of the heat pump apparatus in which the discharge pressure and the suction pressure of the compressor when the outside air temperature is high do not rise excessively the refrigeration cycle is stabilized. That is, the refrigeration cycle is stabilized and its efficiency can be enhanced.

A second aspect of the present invention provides an operating method of a heat pump apparatus, in the drying apparatus of the first aspect, the heat exchanger is used as a second evaporator or a second radiator by operating the first throttle apparatus and the throttle apparatus.

With this aspect, the heat exchanger is utilized as the second radiator in the drying process, the total heat release to the drying air can be increased, an amount of heat transferred to water remaining in the clothing can be secured, it is possible to prevent the drying time from increasing, and the consumption electricity required for the drying operation can be reduced.

According to a third aspect of the invention, in the drying apparatus of the first aspect, the drying apparatus further comprises discharge pressure detecting means for detecting discharge pressure of the compressor, and throttle apparatus control means for controlling the first throttle apparatus and the second throttle apparatus using a detection value from the discharge pressure detecting means.

With this aspect, the heat exchanger can be utilized as the radiator in accordance with the discharge pressure of the compressor, it is possible to prevent the discharge pressure from excessively rising, the reliability of the compressor and the like can reliably be secured, and the refrigeration cycle can be operated stably and efficiently.

According to a fourth aspect of the invention, in the drying apparatus of the first aspect, the drying apparatus further comprises discharge temperature detecting means for detecting discharge temperature of the compressor, and throttle apparatus control means for controlling the first throttle apparatus and the second throttle apparatus using a detection value from the discharge temperature detecting means.

With this aspect, the heat exchanger can be utilized as the radiator in accordance with the discharge temperature of the compressor, it is possible to prevent the discharge pressure from excessively rising, the reliability of the compressor and the like can reliably be secured, and the refrigeration cycle can be operated stably and efficiently.

According to a fifth aspect of the invention, in the drying apparatus of the first aspect, the drying apparatus further comprises air temperature detecting means for detecting inlet air temperature of the evaporator, and throttle apparatus control means for controlling the first throttle apparatus and the second throttle apparatus using a detection value from the air temperature detecting means.

With this aspect, the heat exchanger can be utilized as the radiator in accordance with the inlet air temperature of the evaporator, the heat release can be increased when the drying operation is completed, and it is possible to prevent the drying time from increasing.

According to a sixth aspect of the invention, in the drying apparatus of the first aspect, a high pressure side of the heat pump apparatus is operated as a supercritical state.

With this aspect, heat exchanging efficiency between the refrigerant and the drying air in the radiator can be enhanced, the drying air can be heated to higher temperature and the drying operation can be carried out within a short time.

According to a seventh aspect of the invention, in the drying apparatus of the first aspect, carbon dioxide is used as the refrigerant.

With this aspect, the drying air can be heated to higher temperature, the drying operation can be carried out within a short time, and influence of the global warming can be reduced.

BEST MODE FOR CARRYING OUT THE INVENTION

First Embodiment

Figure 1:
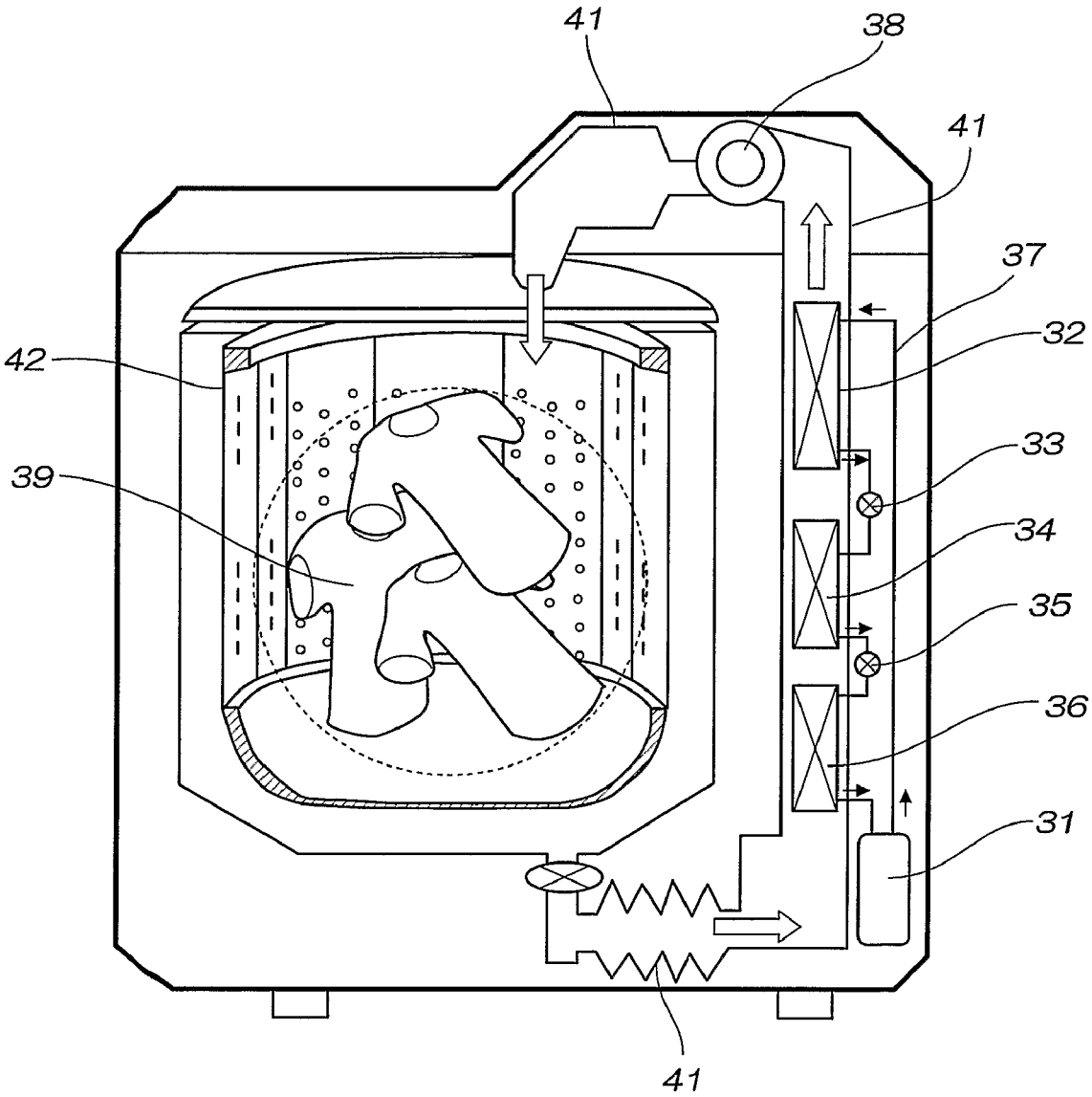
FIG. 1 shows a structure of a heat pump apparatus of a first embodiment of the present invention.
Figure 2:
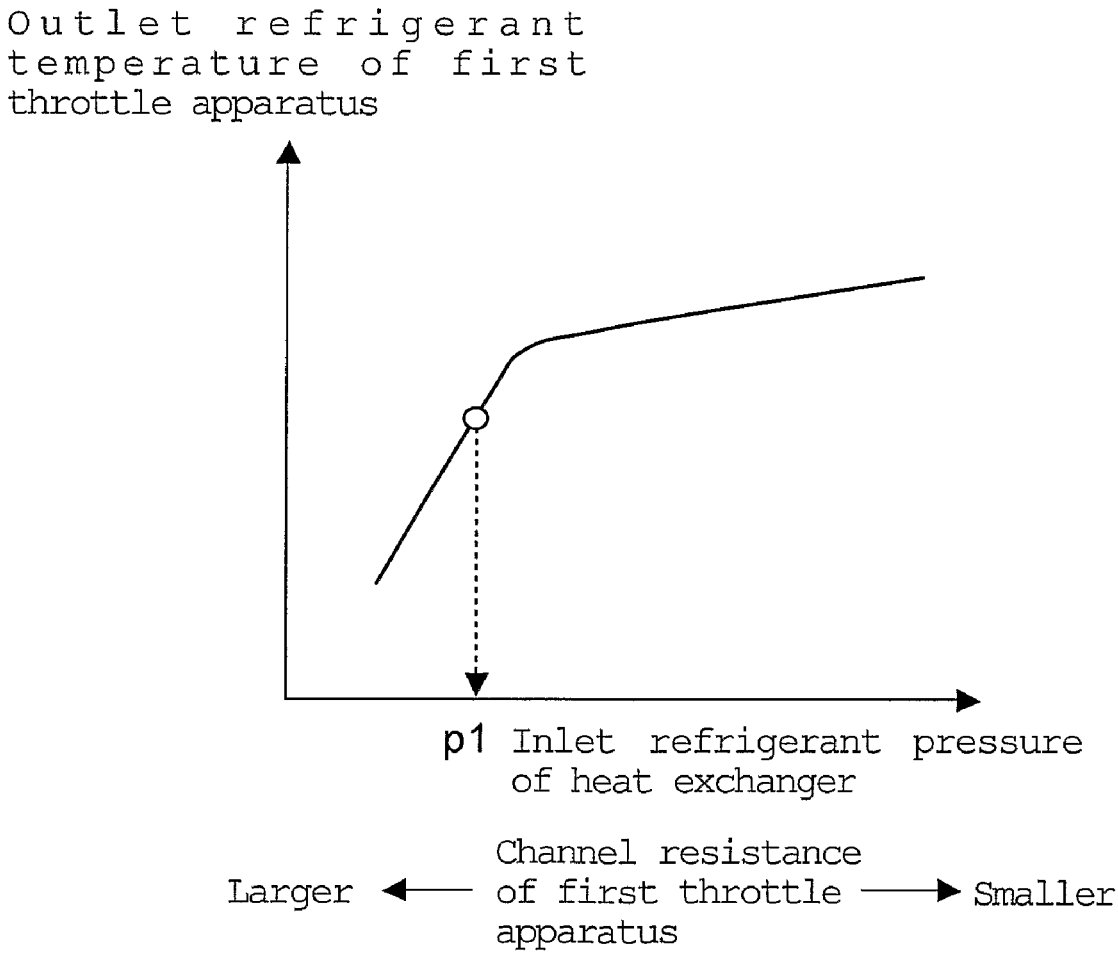
FIG. 2 shows a relation between a channel resistance of a first throttle apparatus and an outlet refrigerant temperature of the first throttle apparatus of the first embodiment of the invention.

Embodiments of the present invention will be explained with reference to the drawings. FIG. 1 shows a structure of a heat pump apparatus of a first embodiment of the present invention. FIG. 2 shows a relation between a channel resistance of a first throttle apparatus and an outlet refrigerant temperature of the first throttle apparatus of the first embodiment of the invention.

In FIG. 1, the heat pump apparatus of the first embodiment has a structure in which the heat pump apparatus is used as a heat source for drying a subject to be dried, and drying air is circulated and reused. The heat pump apparatus comprises a compressor 31 for compressing a refrigerant, a radiator 32 for condensing the refrigerant by heat radiation effect to heat the drying air, a first throttle apparatus 33 for reducing the pressure of the refrigerant, a heat exchanger 34 for controlling to switch the first throttle apparatus 33 and a second throttle apparatus 35 to cause endothermic effect or heat radiation effect, the second throttle apparatus 35 for reducing the pressure of the refrigerant, and an evaporator 36 for evaporating the refrigerant by endothermic effect to dehumidify the drying air. These elements of the heat pump apparatus are connected to one another through a pipe 37 in this order, and the refrigerant is charged. As the refrigerant, a refrigerant which can be brought into a supercritical state on the radiation side, e.g., carbon dioxide or the like is charged.

In a circulation duct 41 of the heat pump apparatus, the radiator 32, the heat exchanger 34 and the evaporator 36 are disposed drying air which is absorbed moisture from a subject to be dried 39 such as clothing placed in the drying room 42 is dehumidified and heated using the radiator 32, the heat exchanger 34 and the evaporator 36, and the drying air is circulated by a blowing fan 38 and reused. In FIG. 1, solid arrows represent a flow of the refrigerant, and hollow arrows represent a flow of the drying air.

Next, the operation of the heat pump of the heat pump apparatus will be explained.

The refrigerant is compressed by the compressor 31 and brought into a high temperature and high pressure state, and the refrigerant radiates heat into the drying air in the radiator 32 and with this, the refrigerant is cooled. Next, the refrigerant passes through the first throttle apparatus 33, and the inlet refrigerant pressure of the heat exchanger 34 is determined by this channel resistance, and the outlet refrigerant temperature (=inlet refrigerant temperature of the heat exchanger 34) of the first throttle apparatus 33 is determined as shown in FIG. 2. That is, if the channel resistance of the first throttle apparatus 33 is controlled, it is possible to arbitrarily set the inlet refrigerant temperature of the heat exchanger 34, and the heat exchanger 34 can be utilized for both heating and dehumidifying the drying air.

That is, if the inlet refrigerant pressure of the heat exchanger 34 is reduced to a certain value (p1) or lower by the first throttle apparatus 33, the heat exchanger 34 functions as a second evaporator (simply, evaporator, hereinafter), and absorbs heat from the drying air. When the drying air is cooled and dehumidified in the heat exchanger 34 (when the inlet refrigerant pressure of the heat exchanger 34 is reduced to p1 or lower by increasing the channel resistance of the first throttle apparatus 33), the refrigerant passes through the second throttle apparatus 35 (without depending upon the channel resistance value of the second throttle apparatus 35) and then, the refrigerant absorbs from heat the drying air which passed through the subject to be dried 39 in the evaporator 36 and with this, the refrigerant is heated, and the refrigerant is again sucked by the compressor 31.

On the other hand, if the inlet refrigerant pressure of the heat exchanger 34 is equal to or higher than the certain value (p1), the heat exchanger 34 functions as a second radiator (simply, radiator, hereinafter), and radiates heat to the drying air. When the drying air is heated in the heat exchanger 34 (when the inlet refrigerant pressure of the heat exchanger 34 is set to p1 or higher by reducing the channel resistance of the first throttle apparatus 33 and increasing the channel resistance of the second throttle apparatus 35), the refrigerant is reduced in pressure by the second throttle apparatus 35, and is brought into a low temperature and low pressure state, the refrigerant absorbs heat from the drying air which passed through the subject to be dried 39 in the evaporator 36 and with this, the refrigerant is heated, and the refrigerant is again sucked by the compressor 31.

Next, a principle of the drying operation of the heat pump apparatus will be explained.

When the drying air is forcibly brought into contact with the subject to be dried 39 by the blowing fan 38, the drying air absorbs moisture from the subject to be dried 39 and is brought into a high moisture state. Then, the drying air is cooled, dehumidified and heated by the evaporator 36, the heat exchanger 34 and the radiator 32 and after the drying air passes through the radiator 32, the drying air is brought into a high temperature and low moisture state. Then, the drying air is forcibly brought into contact with the subject to be dried 39 again, and absorbs moisture from the subject to be dried 39. Based on this principle of the drying operation, the drying air is circulated and reused to absorb moisture from the subject to be dried 39.

With this structure, the first throttle apparatus 33 and the second throttle apparatus 35 are operated, and it is possible to use the heat exchanger 34 by switching as the evaporator or the radiator. With this, under a condition in which discharge pressure or suction pressure of the compressor rises such as a condition in which high outside air temperature in summer season, if the heat exchanger 34 is utilized as the radiator, the discharge pressure or suction pressure of the compressor can be reduced as compared with a case in which the heat exchanger 34 is utilized as the evaporator, the refrigeration cycle is stabilized, and the efficiency of the refrigeration cycle is enhanced.

Here, a principle of reduction in discharge pressure and the suction pressure of the compressor when the heat exchanger 34 is utilizes as the radiator as compared with a case in which the heat exchanger 34 is utilized as the evaporator will be explained. This can be explained using the following relation:

$Q=K\times A\times \Delta t$ (Q: amount of heat, K: overall heat transfer coefficient, A: heating surface area, $\Delta t$: temperature difference between air and refrigerant)

If the case in which the heat exchanger 34 is utilized as the radiator, as compared with the case in which the heat exchanger 34 is utilized as the evaporator, the heating surface area to be utilized for radiating heat to the drying air is increased, and a heating surface area to be utilized for absorbing heat from the drying air is reduced. If the heating surface area to be utilized for radiation is increased, the temperature difference $\Delta T$ between air and refrigerant is reduced and the high pressure side refrigerant temperature approaches the air temperature under a condition in which the overall heat transfer coefficient K and heat release Q are constant. Since the refrigerant temperature is always equal to or higher than the drying air temperature on the high pressure side, the refrigerant temperature is shifted in a direction where the refrigerant temperature is reduced. That is, the high pressure side refrigerant pressure is reduced.

If the heating surface area utilized for absorbing heat is reduced, the temperature difference $\Delta T$ between air and refrigerant is increased under the condition in which the overall heat transfer coefficient K and heat release Q are constant. Since the refrigerant temperature is always equal to or lower than the drying air temperature on the low pressure side, the refrigerant temperature is shifted in a direction where the refrigerant temperature is reduced. That is, the low pressure side refrigerant pressure is reduced.

This is the principle of reduction in the discharge pressure and the suction pressure of the compressor when the heat exchanger 34 is utilized as the radiator as compared with the case in which the heat exchanger 34 is utilized as the evaporator.

According to the heat pump apparatus of this embodiment, by properly using the heat exchanger 34 as the radiator or the evaporator, the heat pump apparatus can always be operated in a stable state without relying on the outside air condition. It is possible to suppress the deterioration of the efficiency (COP) of the refrigeration cycle caused by increase in discharge pressure or suction pressure of the compressor unlike the conventional technique, consumption of electricity required for the drying operation can be reduced, and energy can be saved.

The heat pump apparatus of this embodiment uses a transition critical refrigeration cycle using $CO_2$ refrigerant. Therefore, as compared with a conventional subcritical refrigeration cycle using HFC refrigerant, heat exchanging efficiency between $CO_2$ refrigerant and the drying air in the radiator 32 can be enhanced, and the temperature of the drying air can be increased to high temperature. Thus, the ability for absorbing moisture from the subject to be dried 39 is increased, and it is possible to dry within a short time.

In this embodiment, $CO_2$ refrigerant which is brought into supercritical state on the radiation side is used, but even if the conventional HFC refrigerant is used, the same effect can be obtained.

Second Embodiment

Figure 3:
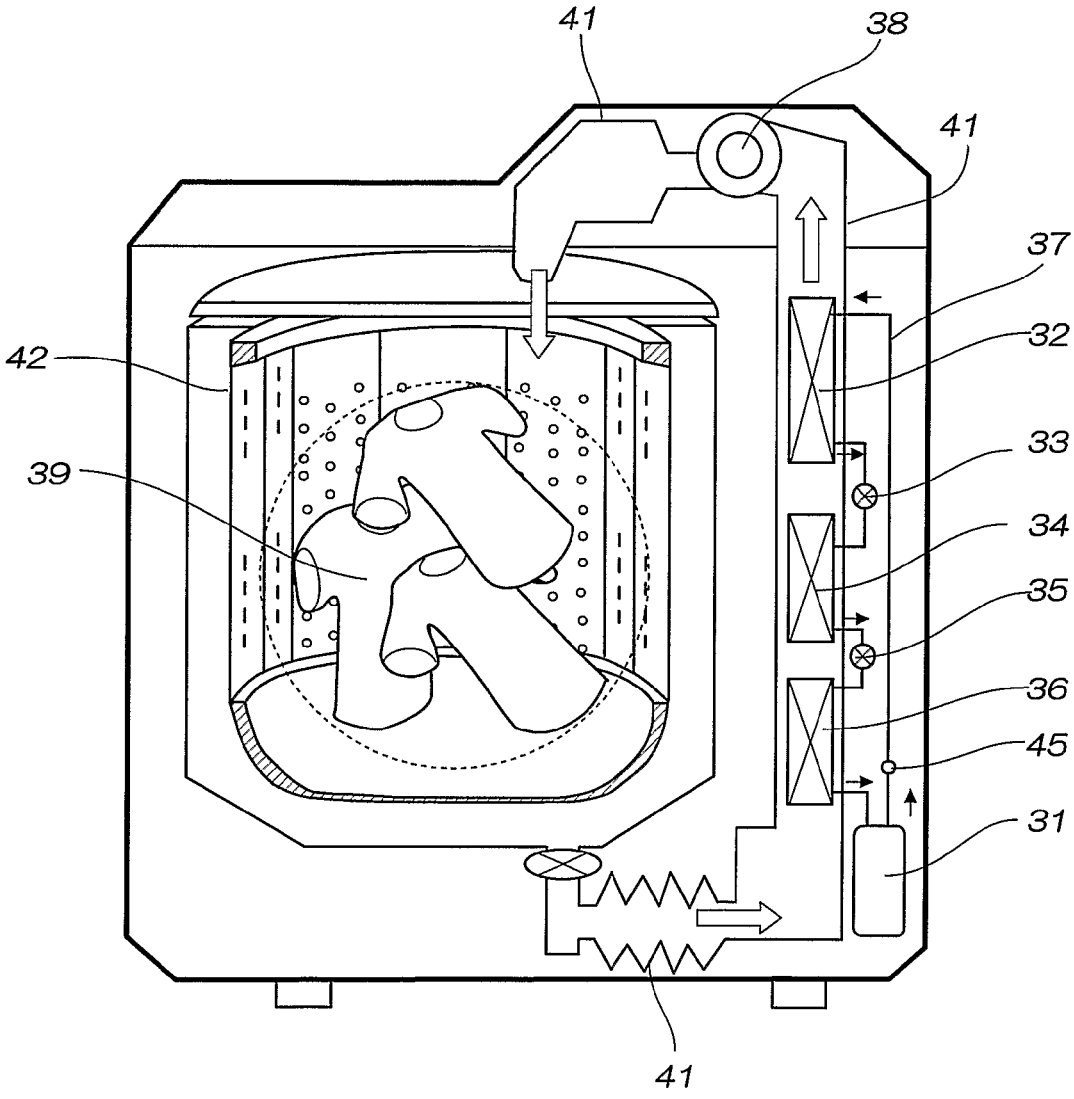
FIG. 3 shows a structure of a heat pump apparatus of a second embodiment of the invention.
Figure 4:
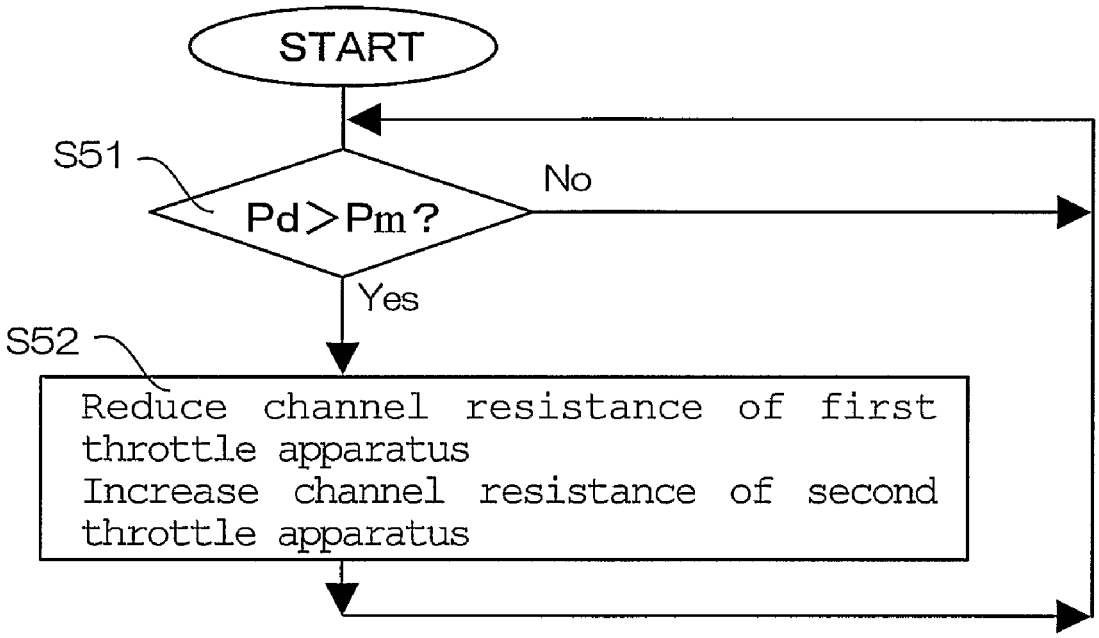
FIG. 4 is a control flowchart of the heat pump apparatus of the second embodiment.

FIG. 3 shows a structure of a heat pump apparatus of a second embodiment of the invention. FIG. 4 is a control flowchart of the heat pump apparatus of the second embodiment.

In the following explanation of the second embodiment, the same structures as those of the first embodiment are designated with the same symbols, explanation thereof will be omitted, and the structures of the second embodiment which are different from those of the first embodiment will be explained.

The heat pump apparatus of the second embodiment comprises, in addition to the structures of the first embodiment, discharge pressure detecting means 45 for detecting the discharge pressure of the compressor 31, and throttle apparatus control means (not shown) for controlling the first throttle apparatus 33 and a second throttle apparatus 35 using a detection value from the discharge pressure detecting means 45.

The operation of the heat pump apparatus will be explained.

As shown in FIG. 4, discharge pressure Pd detected by the discharge pressure detecting means 45 and target set pressure Pm (e. g., 10 MPa) are compared with each other in step 51. If Pd is greater than Pm, it is determined that the heat exchanger 34 is utilized as a radiator, and control is performed to reduce the channel resistance of the first throttle apparatus 33 and to increase the channel resistance of the second throttle apparatus 35 (step 52) and then, the procedure is returned to step 51.

Channel resistance values $\Delta P1a$ and $\Delta P2a$ of the first throttle apparatus 33 and the second throttle apparatus 35 when the heat exchanger 34 is utilized as the radiator are previously set, and when Pd is greater than Pm, control may be performed to change the channel resistance values of the first throttle apparatus 33 and the second throttle apparatus 35 to $\Delta P1a$ and $\Delta P2a$.

As described above, in the heat pump apparatus of the second embodiment, the discharge pressure of the compressor 31 is detected, and the channel resistances of the first throttle apparatus 33 and the second throttle apparatus 35 are controlled based on the detected discharge pressure. With this, the heat exchanger 34 can be utilized as a radiator, and it is possible to prevent the discharge pressure from rising excessively. That is, reliability of the compressor 31 and the heat pump apparatus can more reliably be secured, and by operating the stable and efficient refrigeration cycle, the input into the compressor 31 can be reduced, and energy can be saved.

Third Embodiment

Figure 5:
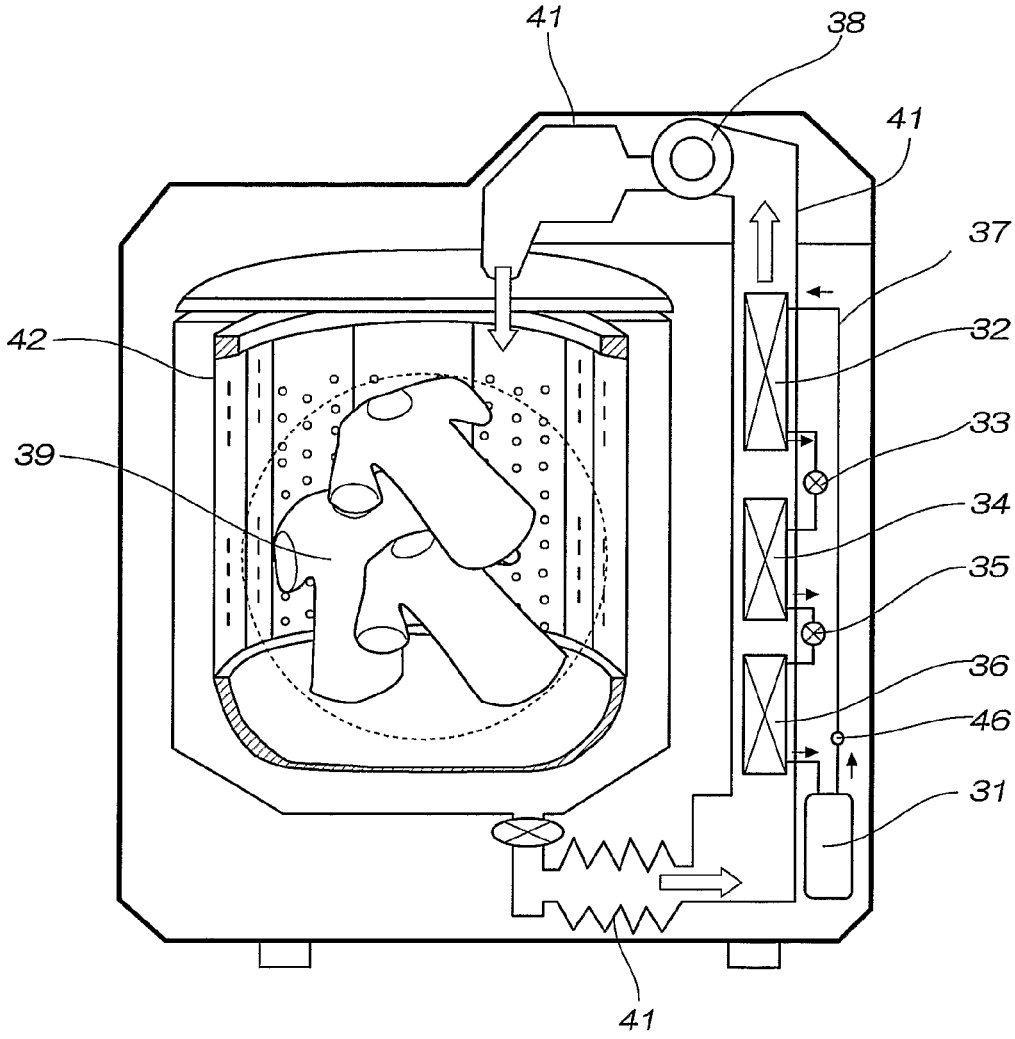
FIG. 5 shows a structure of a heat pump apparatus of a third embodiment of the invention.
Figure 6:
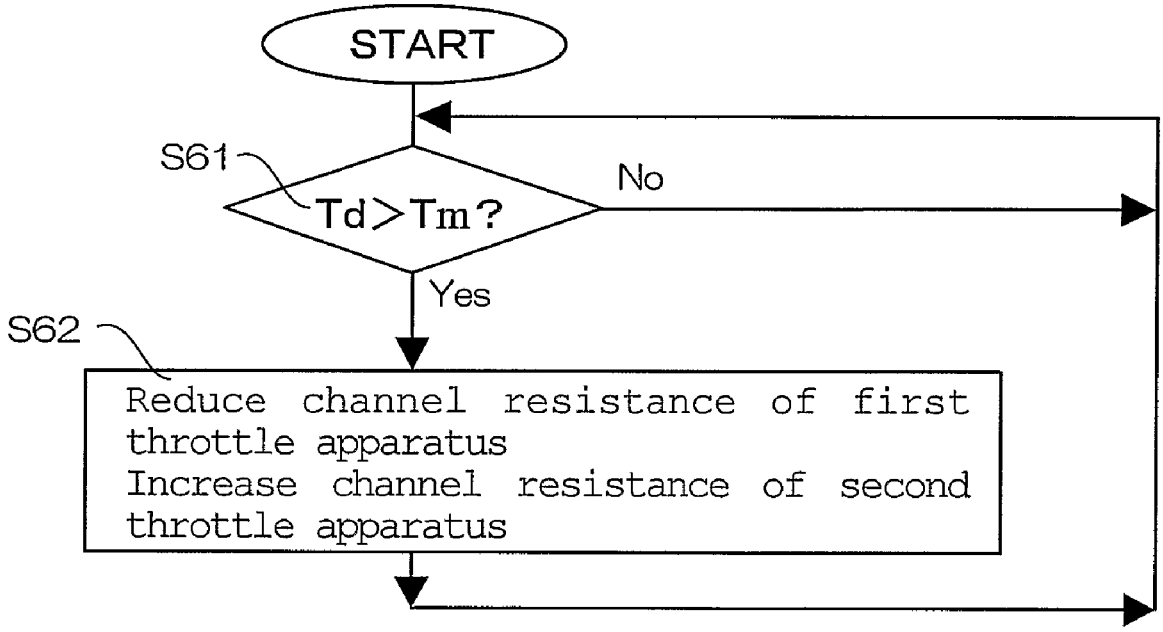
FIG. 6 is a control flowchart of the heat pump apparatus of the third embodiment.

FIG. 5 shows a structure of a heat pump apparatus of a third embodiment of the invention. FIG. 6 is a control flowchart of the heat pump apparatus of the third embodiment.

The heat pump apparatus of the third embodiment comprises, in addition to the structures of the first embodiment, discharge temperature detecting means 46 for detecting the discharge temperature of the compressor 31, and throttle apparatus control means (not shown) for controlling the first throttle apparatus 33 and the second throttle apparatus 35 using a detection value from the discharge temperature detecting means 46.

The operation of the heat pump apparatus will be explained.

As shown in FIG. 6, discharge temperature Td detected by the discharge temperature detecting means 46 and target set temperature Tm (e.g., 100° C.) are compared with each other in step 61. If Td is greater than Tm, it is determined that the heat exchanger 34 is utilized as a radiator, and control is performed to reduce the channel resistance of the first throttle apparatus 33 and to increase the channel resistance of the second throttle apparatus 35 (step 62) and then, the procedure is returned to step 61.

Channel resistance values $\Delta P1b$ and $\Delta P2b$ of the first throttle apparatus 33 and the second throttle apparatus 35 when the heat exchanger 34 is utilized as the radiator are previously set, and when Td is greater than Tm, control may be performed to change the channel resistance values of the first throttle apparatus 33 and the second throttle apparatus 35 to $\Delta P1b$ and $\Delta P2b$.

As described above, in the heat pump apparatus of the third embodiment, the discharge temperature of the compressor 31 is detected, and the channel resistances of the first throttle apparatus 33 and the second throttle apparatus 35 are controlled based on the detected discharge temperature. With this, the heat exchanger 34 can be utilized as a radiator, and it is possible to prevent the discharge pressure from rising excessively. That is, reliability of the compressor 31 and the heat pump apparatus can more reliably be secured, and by operating the stable and efficient refrigeration cycle, the input into the compressor 31 can be reduced, and energy can be saved.

Fourth Embodiment

Figure 7:
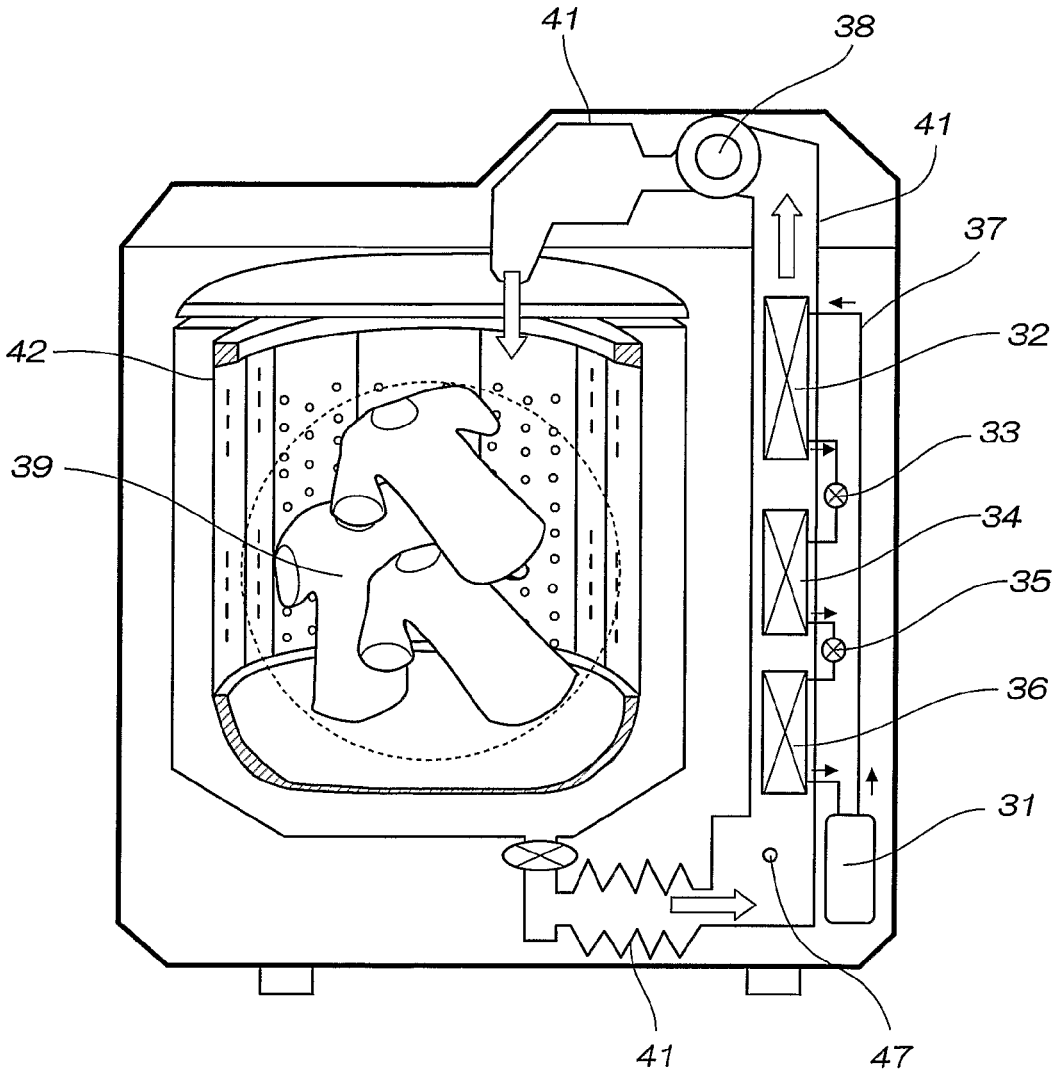
FIG. 7 shows a structure of a heat pump apparatus of a fourth embodiment of the invention.
Figure 8:
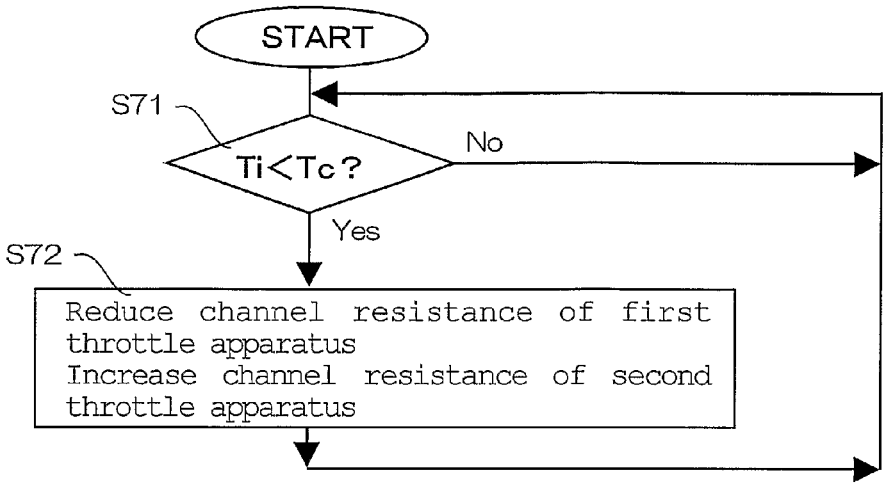
FIG. 8 is a control flowchart of the heat pump apparatus of the fourth embodiment.
Figure 9:
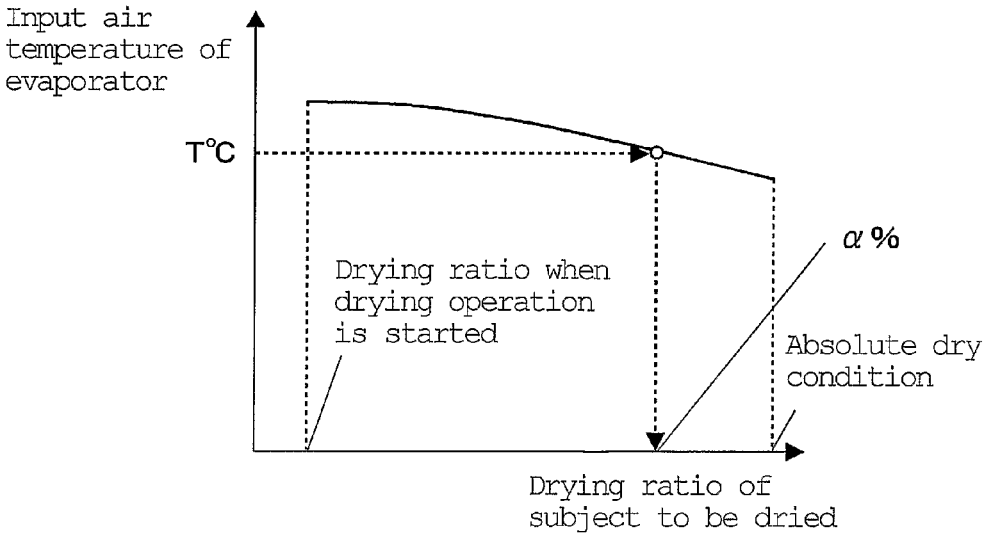
FIG. 9 shows a relation between the inlet air temperature of an evaporator and a dry ratio of a subject to be dried in the fourth embodiment.
Figure 10:
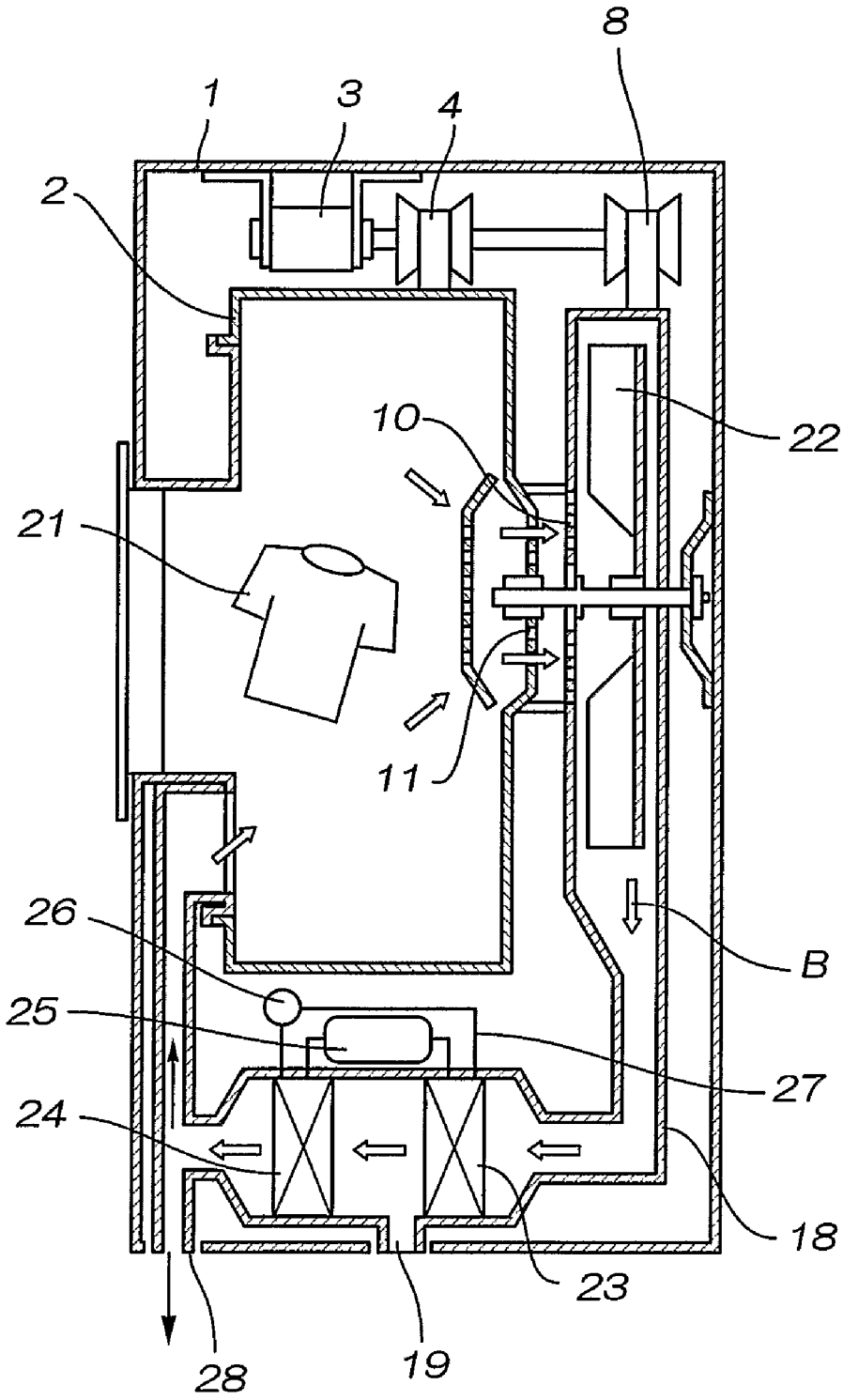
FIG. 10 shows a structure of a conventional heat pump apparatus.
Figure 11:
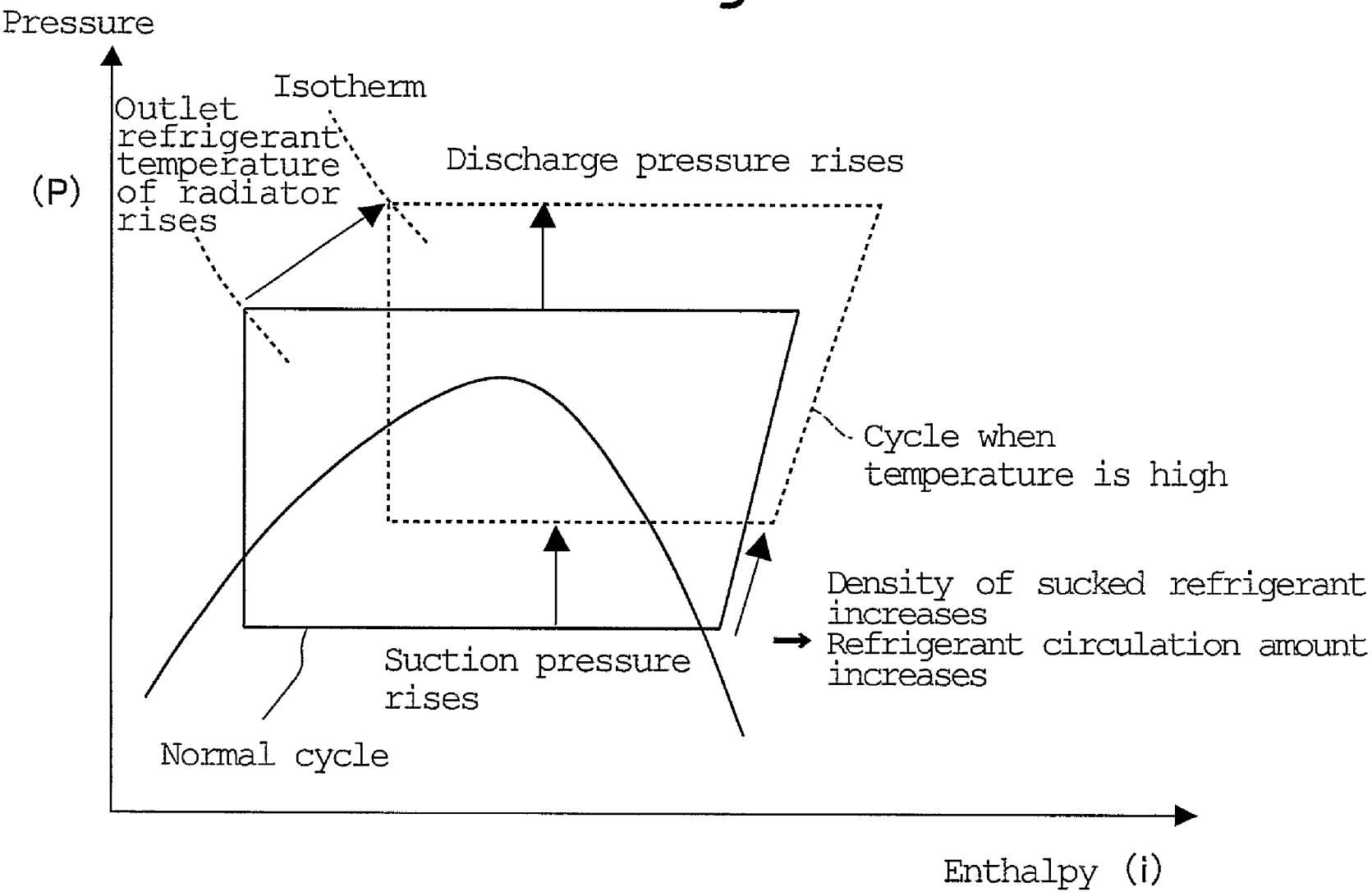
FIG. 11 is a Mollier diagram showing a refrigeration cycle in the conventional heat pump apparatus when the apparatus is operated at high temperature.

FIG. 7 shows a structure of a heat pump apparatus of a fourth embodiment of the invention. FIG. 8 is a control flowchart of the heat pump apparatus of the fourth embodiment. FIG. 9 shows a relation between the inlet air temperature of an evaporator and a dry ratio of a subject to be dried in the fourth embodiment.

The heat pump apparatus of the fourth embodiment comprises, in addition to the structures of the first embodiment, air temperature detecting means 47 for detecting inlet air temperature of the evaporator 36, and throttle apparatus control means (not shown) for controlling the first throttle apparatus 33 and the second throttle apparatus 35 using a detection value from the air temperature detecting means 47.

There is a relation shown in FIG. 9 between the inlet air temperature of the evaporator 36 and a dry ratio of the subject to be dried 39. If the inlet air temperature is detected, it is possible to grasp the proceeding degree of the drying operation. This is because that as the drying operation is proceeded, an amount of dehumidified water from the drying air in the evaporator 36 is reduced and thus, of an amount of heat absorbed by the refrigerant from the drying air, an amount of heat to be absorbed as latent heat is reduced, and amount of heat to be absorbed as sensible heat is increased. Thus, if the inlet air temperature of the evaporator 36 is detected, it is possible to control the first throttle apparatus 33 and the second throttle apparatus 35 in accordance with the proceeding degree of the drying operation.

The operation of the heat pump apparatus will be explained.

As shown in FIG. 8, inlet air temperature Ti detected by the air temperature detecting means 47 and a target set temperature Tc (e.g., 40° C.) are compared with each other in step 71. If Ti is smaller than Tc, it is determined that the heat exchanger 34 is utilized as a radiator, and control is performed to reduce the channel resistance of the first throttle apparatus 33 and to increase the channel resistance of the second throttle apparatus 35 (step 72) and then, the procedure is returned to step 71.

Channel resistance values $\Delta P1c$ and $\Delta P2c$ of the first throttle apparatus 33 and the second throttle apparatus 35 when the heat exchanger 34 is utilized as the radiator are previously set, and when Ti is smaller than Tc, control may be performed to change the channel resistance values of the first throttle apparatus 33 and the second throttle apparatus 35 to $\Delta P1c$ and $\Delta P2c$. With this, the same effect can be obtained.

The discharge pressure detecting means 45 of the second embodiment and the air temperature detecting means 47 of this embodiment may be combined, or the discharge temperature detecting means 46 of the third embodiment and the air temperature detecting means 47 of this embodiment may be combined. With this, synergistic effect can be obtained.

As described above, in the heat pump apparatus of the fourth embodiment, the inlet air temperature of the evaporator 36 is detected, and the channel resistances of the first throttle apparatus 33 and the second throttle apparatus 35 are controlled based on the detected inlet air temperature. Thus, although an amount of heat transferred to water remaining in the clothing is reduced when the drying operation is completed in the conventional example, since the heat exchanger 34 is utilized as the radiator in the present invention, the heat release can be increased as compared with the conventional example, and it is possible to prevent the drying time from increasing, and the consumption of electricity required for the drying operation can be reduced.

The present invention has effect not only when the invention is used for drying clothing, but also when the invention is used for drying a bathroom, tableware and the like and the invention has effect when the invention is applied to a heat pump apparatus such as a vending machine.

According to the heat pump apparatus of the invention, since the heat exchanger can be utilized as a radiator and as an evaporator, the discharge pressure or suction pressure of the compressor does not excessively rise when the outside air temperature is high. Thus, the refrigeration cycle is stabilized, and the efficiency of the refrigeration cycle is enhanced, and the consumption of electricity required for the drying operation can be reduced.

When the heat pump apparatus is used for drying operation, since the use of the heat exchanger can be switched from the evaporator to the radiator, it is possible to always secure the amount of heat transferred to water remaining in clothing, and to prevent the drying time from increasing, and the consumption of electricity required for the drying operation can be reduced.

INDUSTRIAL APPLICABILITY

The drying apparatus of the present invention can suitably be used for drying clothing, bathroom and the like. Further, the heat pump apparatus can also be used for other application such as for drying tableware, garbage and the like, and can also be applied to a vending machine and the like.

The invention claimed is:

1. A heat pump apparatus comprising:

a compressor for compressing a refrigerant;

a circulation duct having an air inlet and an air outlet at respective ends thereof for circulating drying air therethrough in a direction from the air inlet to the air outlet;

a radiator, disposed inside said circulation duct and immediately adjacent to the air outlet, for condensing the refrigerant to heat the drying air;

an evaporator, disposed inside said circulation duct and immediately adjacent to the air inlet, for evaporating the refrigerant to absorb heat from the drying air;

a first throttle apparatus and a second throttle apparatus for controlling the refrigerant pressure;

a heat exchanger, disposed inside said circulation duct and connected between said first throttle apparatus and said second throttle apparatus, functioning as another radiator for condensing the refrigerant to heat the drying air or as another evaporator for evaporating the refrigerant to absorb heat from the drying air, depending on the refrigerant pressure controlled by said first throttle apparatus and said second throttle apparatus;

a drying room, connected to said circulation duct thus constituting a circulatory path for the drying air, for offering a space to place a subject to be dried; and a refrigerant pipe connecting, in the following order, said compressor; said radiator; said first throttle apparatus; said heat exchanger; said second throttle apparatus; and said evaporator, in a series circuit of the refrigerant.

2. The heat pump apparatus according to claim 1, further comprising a discharge-pressure detector for detecting discharge pressure of said compressor, and a throttle-apparatus controller for controlling said first throttle apparatus and said second throttle apparatus depending on the discharge pressure detected by said discharge-pressure detector.

3. The heat pump apparatus according to claim 1, further comprising a discharge-temperature detector for detecting discharge temperature of said compressor, and a throttle-apparatus controller for controlling said first throttle apparatus and said second throttle apparatus depending on the discharge temperature detected by said discharge-temperature detector.

4. The heat pump apparatus according to claim 1, further comprising an air-temperature detector for detecting inlet air temperature of said evaporator, and a throttle-apparatus controller for controlling said first throttle apparatus and said second throttle apparatus depending on the inlet air temperature detected by said air-temperature detector.

5. The heat pump apparatus according to claim 1, wherein the refrigerant is carbon dioxide.

6. The heat pump apparatus according to claim 1, wherein said heat exchanger functions as another radiator when the refrigerant pressure controlled by said first throttle apparatus and said second throttle apparatus is equal to or higher than a certain value and as another evaporator when the refrigerant pressure controlled by said first throttle apparatus and said second throttle apparatus is lower than the certain value.

* * * * *